US006343484B1

(12) United States Patent
Hong et al.

(10) Patent No.: US 6,343,484 B1
(45) Date of Patent: Feb. 5, 2002

(54) AIR BLOWING APPARATUS OF AIR CONDITIONER

(75) Inventors: Young-Ki Hong, Anyang; Byung-Han Lim, Suwon; Weon-Seok Choi, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/596,553

(22) Filed: Jun. 19, 2000

(30) Foreign Application Priority Data

Jul. 28, 1999 (KR) ..... 99-30816

(51) Int. Cl.[7] ..... F25D 17/06

(52) U.S. Cl. ..... 62/428; 62/411

(58) Field of Search ..... 62/262, 428, 259.1, 62/263, 411, 412, 409, 507, 508

(56) References Cited

U.S. PATENT DOCUMENTS 2,751,760 A * 6/1956 Williams
4,976,115 A * 12/1990 Hogan ..... 62/428
5,215,441 A * 6/1993 Evans et al. ..... 62/280 X
5,895,206 A * 4/1999 Chuang et al. ..... 416/189

* cited by examiner

*Primary Examiner*—Henry Bennett
*Assistant Examiner*—Chen-Wen Jiang
(74) *Attorney, Agent, or Firm*—Robert E. Bushnell, Esq.

(57) ABSTRACT

An air blowing apparatus of an air conditioner having an outdoor fan which includes a hub and vanes faced with a condenser at a predetermined distance, wherein the outdoor fan is assembled at a distance between the hub and the condenser no larger than 1.3 times the distance between the vanes and the condenser, thereby preventing a whirling phenomenon, in which air is infused toward the center of the hub in rotations of the outdoor fan and accomplishing smooth condensation by getting normal air flow to form at the center of the condenser faced with the hub.

16 Claims, 3 Drawing Sheets

AIR BLOWING APPARATUS OF AIR CONDITIONER

CLAIM OF PRIORITY

This application makes reference to, incorporates the same herein, and claims all benefits accruing under 35 U.S.C. §119 from an application for A Blowing Apparatus of Air Conditioner earlier filed in the Korean Industrial Property Office on Jul. 28, 1999 and there duly assigned Serial No. 30816/1999.

BACKGROUND OF THE INVENTION

1. Field of the Invention

The present invention relates to a window type air conditioner, and more particularly to an air blowing apparatus of an air conditioner for preventing blown air from flowing backward by improving a gap between an outdoor fan and a condenser.

2. Brief Description of the Related Art

In general, a conventional window type air conditioner includes a vaporizing unit installed at the front portion of a base panel for heat-exchanging the infused room air to cool air, a blade frame mounted at one lateral upper end of the vaporizing unit for partitioning and discharging the cool air heat-exchanged by passing through the vaporizing unit and a control box assembled at the lower portion of the blade frame for controlling operations of the product and accommodating electronic parts.

Here, the vaporizing unit and blade frame are coupled with an internal case secured at the top surface. The control box is coupled with a lateral surface and a lower surface of the blade frame. A plurality of vertical blades are installed inside the blade frame for horizontally controlling air flow which has been heat-exchanged and discharged through all area of the blade frame.

An external panel is mounted on the base panel for forming an external appearance of the product by covering all of its sides except its front side, wherein a plurality of infusing holes are formed on both sides of the external panel for getting the outside air to be infused into the product. A front panel covers the front portion of the external panel for forming its front appearance of the product with inflow and outflow of room air.

Here, the front panel includes a suction inlet at an area corresponding to the vaporizing unit for allowing a suction grill member to be attached or detached and a discharging outlet at an area corresponding to the blade frame for discharging the beat-exchanged air out of the product and a rectangular space at an area corresponding to the control box.

Furthermore, the suction grill member of a window shape is inserted at the suction inlet, allowing attachment and detachment thereof. On the other hand, a plurality of horizontal blades are vertically installed in a predetermined interval for controlling vertical flow of the room air discharging out through all area of the discharging outlet, allowing their vertical movements.

In addition, a compressor is installed at one middle portion of the base panel for compressing circulating coolant to the coolant of high temperature and high pressure to be supplied into the vaporizing unit. An external case is installed at rear portion of the base panel for supporting a condenser. A plurality of brackets are coupled at the upper inner surface of the external panel for keeping constant a predetermined horizontal interval set between the external case and the internal case.

Furthermore, a partition is installed behind the internal case for covering the rear side of the vaporizing unit, blade frame and control box. Air blowing means is installed between the partition and the external case for forcibly infusing and circulating room air and outside air to an internal space and an external space divided by the partition, and for discharging the air.

The air blowing means includes a motor to be driven by supply power, an indoor fan, which may be a centrifugal fan, installed at the internal space via the motor and a motor axis for rotating along with the driven motor to forcibly induce the room air to the suction grill member, the suction inlet of the front panel and the vaporizing unit in sequence and an outdoor fan which may be of a propeller shape, installed at the external space via the other motor axis of the motor for rotating along with the motor to forcibly infuse outside air to the external space through the infusing hole of the external panel and discharge out through the condenser at the same time.

The outdoor fan includes a hub coupled at an end of the motor axis to avoid racing, and a plurality of vanes distributed evenly around an external periphery surface of the hub and assembled at a predetermined gap to bell-mouth shaped through hole of the external case for generating air.

However, in the air blowing apparatus of the conventional air conditioner thus constructed, the distance between the center of the hub of the outdoor fan and the condenser is larger than the distance between the end of the vane of the outdoor fan and the condenser, which can lead to a so-called whirling phenomenon, or vortex, in which air can be infused toward the hub at the center of the condenser faced with the hub when the outdoor fan is rotated.

Such a whirling phenomenon will not occur if the outdoor fan is installed far enough from the condenser. However, as recent models of air conditioners are made smaller, the outdoor fan is more closely installed to the condenser. As a result, normal air flow in the positive (+) state of air velocity may form at the region between the end of the vane and that of the condenser. On the other hand, a backward air flow in the negative (−) state of air velocity may form at the region between the center of the hub and the condenser. Therefore, condensation is not smoothly accomplished at the center of the condenser.

SUMMARY OF THE INVENTION

It is therefore an object of the present invention to provide an improved air conditioner.

A further object of the present invention is to improve the air blowing apparatus of an air conditioner.

A yet further object of the invention is to provide an air blowing apparatus of an air conditioner which eliminates a vortex near the hub of the outdoor fan.

A still further object of the invention is to achieve better condensation in the condenser near the hub of the outdoor fan.

Another object of the invention is to provide an air conditioner which can be made smaller.

Yet another object of the invention is to provide an air conditioner which has greater cooling capacity.

Still another object of the invention is to provide an air conditioner which has reduced energy consumption and greater energy efficiency.

The present invention is presented to achieve the above objects, by providing an air blowing apparatus of an air conditioner for reducing variations in the distance between a hub of an outdoor fan and a condenser and that between the vane of the outdoor fan and the condenser to thereby eliminate a whirling phenomenon, in which air is infused toward the center of the hub in rotation of the outdoor fan, and to accomplish smooth condensation at the center of the condenser facing the hub.

In order to accomplish the aforementioned objects of the present invention, there is provided an air blowing apparatus of an air conditioner having an outdoor fan which includes a hub and vanes faced with a condenser at a predetermined distance, wherein the outdoor fan is assembled at a distance between the hub and the condenser no larger than 1.3 times the distance between vanes and the condenser.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
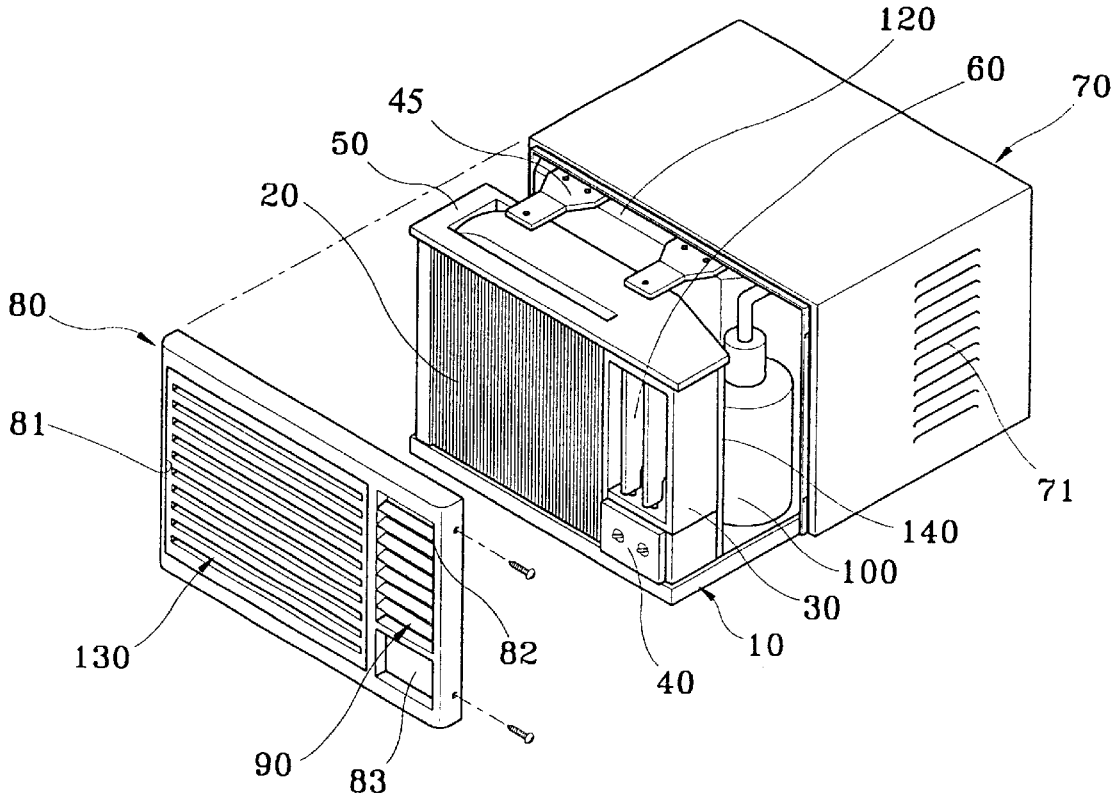
FIG. 1 (PRIOR ART)
FIG. 1 is a partial analytical perspective view for illustrating a conventional air conditioner.
Figure 2:
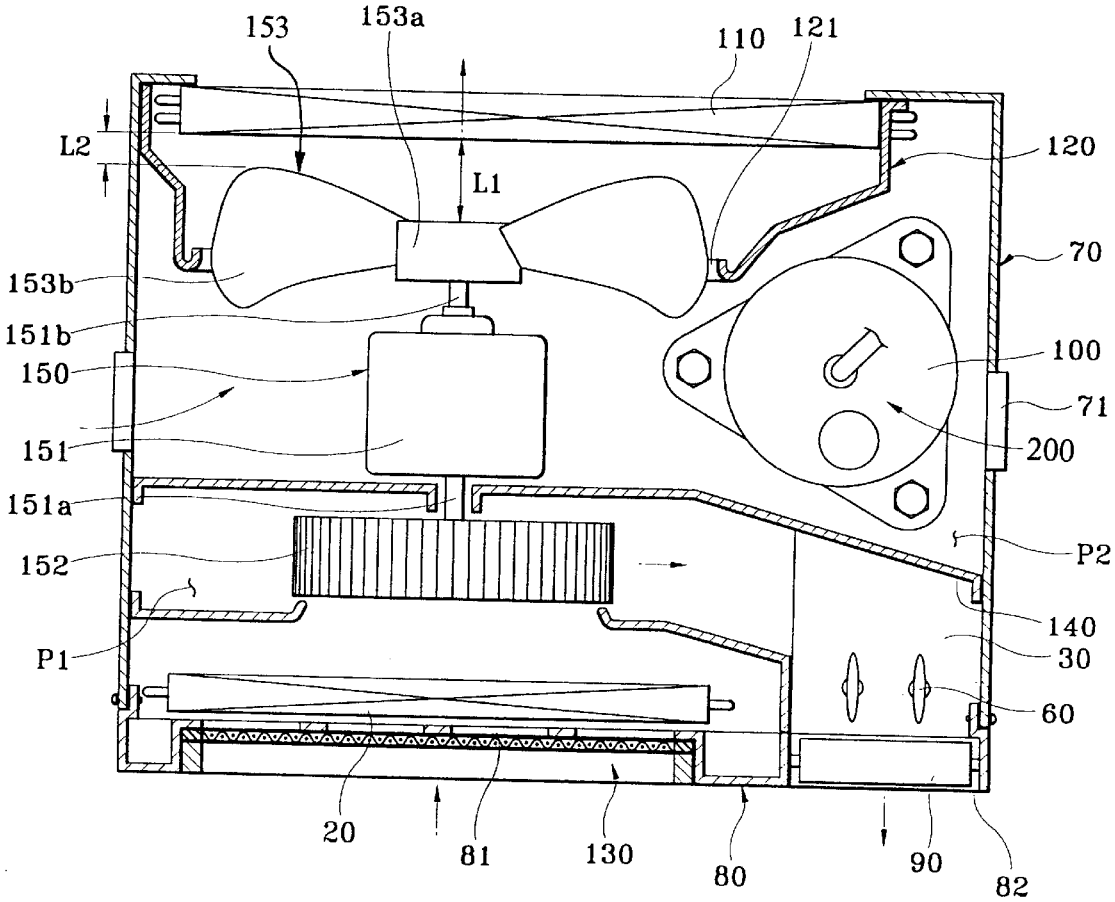
FIG. 2 (PRIOR ART)
FIG. 2 is a plane cross-sectional view for illustrating an air blowing apparatus of a conventional air conditioner.

Turning now to the drawings, the conventional window type air conditioner described above will now be described with reference to the drawings. In general, a conventional window type air conditioner, as shown in FIGS. 1 and 2, includes a vaporizing unit 20 installed at the front portion of a base panel 10 for heat-exchanging the infused room air to cool air, a blade frame 30 mounted at one lateral upper end of the vaporizing unit 20 for partitioning and discharging the cool air heat-exchanged by passing through the vaporizing unit 20 and a control box 40 assembled at the lower portion of the blade frame 30 for controlling operations of the product and accommodating electronic parts.

Here, the vaporizing unit 20 and blade frame 30 are coupled with an internal case 50 secured at the top surface. The control box 40 is coupled with a lateral surface and a lower surface of the blade frame 30. A plurality of vertical blades 60 are installed inside the blade frame 30 for horizontally controlling air flow which has been heat-exchanged and discharged through all area of the blade frame 30.

An external panel 70 is mounted on the base panel 10 for forming an external appearance of the product by covering all of its sides except its front side, wherein a plurality of infusing holes 71 are formed on both sides of the external panel 70 for getting the outside air to be infused into the product. A front panel 80 covers the front portion of the external panel 70 for forming its front appearance of the product with inflow and outflow of room air.

Here, the front panel 80 includes a suction inlet 81 at an area corresponding to the vaporizing unit 20 for allowing a suction grill member to be attached or detached and a discharging outlet 82 at an area corresponding to the blade frame 30 for discharging the heat-exchanged air out of the product and a rectangular space 83 at an area corresponding to the control box 40.

Furthermore, the suction grill member 130 of a window shape is inserted at the suction inlet 81, allowing attachment and detachment thereof. On the other hand, a plurality of horizontal blades 90 are vertically installed in a predetermined interval for controlling vertical flow of the room air discharging out through all area of the discharging outlet 82, allowing their vertical movements.

In addition, a compressor 100 is installed at one middle portion of the base panel 10 for compressing circulating coolant to the coolant of high temperature and high pressure to be supplied into the vaporizing unit 20. An external case 120 is installed at rear portion of the base panel 10 for supporting a condenser 110. A plurality of brackets 45 are coupled at the upper inner surface of the external panel 70 for keeping constant a predetermined horizontal interval set between external case 120 and internal case 50.

Furthermore, a partition 140 is installed behind the internal case 50 for covering the rear side of the vaporizing unit 20, blade frame 30 and control box 40. Air blowing means 150 is installed between the partition 140 and the external case 120 for forcibly infusing and circulating room air and outside air to internal space P1 and external space P2 divided by the partition 140 and for discharging the air.

The air blowing means 150 includes a motor 151 to be driven by supply power, an indoor fan 152, which may be a centrifugal fan, installed at the internal space P1 via the motor 151 and a motor axis 151*a* for rotating along with the driven motor to forcibly induce the room air to the suction grill member 130, the suction inlet 81 of the front panel 10 and the vaporizing unit 20 in sequence and an outdoor fan 153 which is a radial fan which may be of a propeller shape, installed at the external space P2 via the other motor axis 151*b* of the motor 151 for rotating along with the motor 151 to forcibly infuse outside air (arrow 200) to the external space P2 through the infusing hole 71 of the external panel 70 and discharge out through the condenser 110 at the same time.

The outdoor fan 153 includes a hub 153*a* coupled at an end of the motor axis 151*b* to avoid racing, and a plurality of vanes 153*b* distributed evenly around an external periphery surface of the hub 153*a* and assembled at a predetermined gap to bell-mouth shaped through hole 121 of the external case 120 for generating air.

However, as shown in FIG. 2, in the air blowing apparatus of the conventional air conditioner thus constructed, the distance L1 between the center of the hub 153*a* of the outdoor fan 153 and the condenser 110 is larger than the distance L2 between the end of the vane 153*b* of the outdoor fan 153 and the condenser 110, which can lead to a so-called whirling phenomenon, or vortex, in which air can be infused toward the hub 153*a* at the center of the condenser 110 faced with the hub 153*a* when the outdoor fan 153 is rotated.

Figure 3:
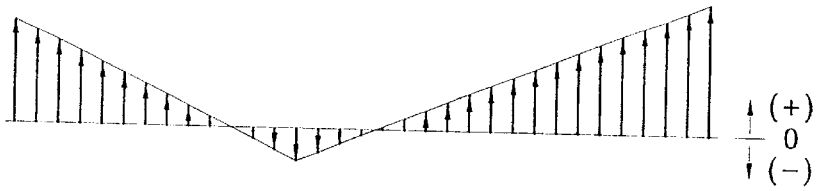
FIG. 3 (PRIOR ART)
FIG. 3 is an air velocity distribution graph of air flow across the condenser of a conventional air conditioner.

Such a whirling phenomenon will not occur if the outdoor fan 153 is installed far enough from the condenser 110. However, as recent models of air conditioners are made smaller, the outdoor fan 153 is more closely installed to the condenser 110. As a result, as shown in the air velocity distribution graph of FIG. 3, normal air flow in its plus, or positive (+) state of air velocity may form at the distance L2 between the end of the vane 153*b* and that of the condenser 110. On the other hand, a backward air flow in its minus, or negative (−) state of air velocity may form when the hub is at distance L1 between the center of the hub 153*a* and that of the condenser 110, as shown in FIG. 2. Therefore, condensation is not smoothly accomplished at the center of the condenser 110.

An embodiment of the present invention will be now described in detail with reference to accompanying drawings. It should be noted that the same or similar reference numerals of the prior art are used for the same or similar parts in the drawings of the present invention and the detailed descriptions for those parts will be omitted.

Figure 4:
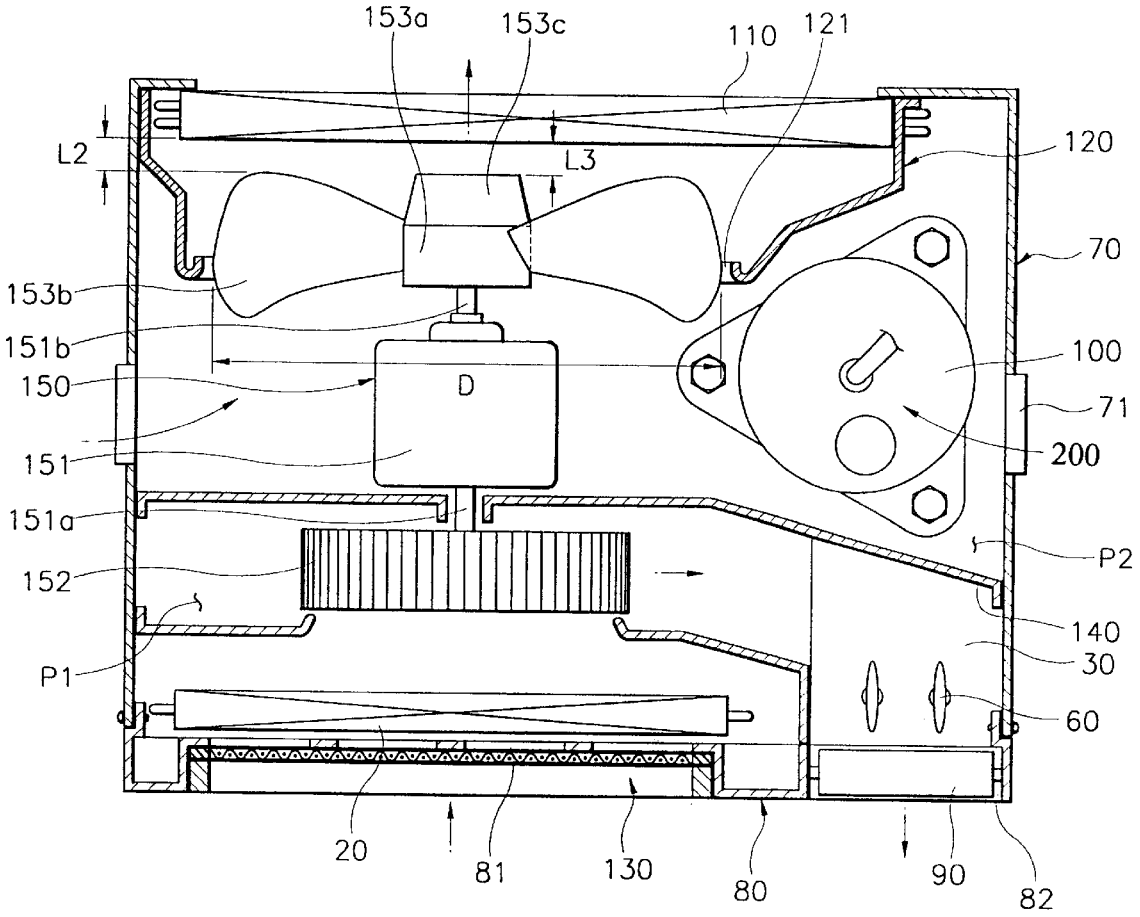
FIG. 4 is a plane cross-sectional view for illustrating an air blowing apparatus of an air conditioner in accordance with an embodiment of the present invention.

As shown in FIG. 4, an air blowing apparatus of the air conditioner of the present invention is constructed with an extended part 153*c* protruded toward a condenser 110 on the hub 153*a* of an outdoor fan 153 for reducing the distance L3 between the hub 153*a* and the center of the condenser 110 less than or equal to 1.3 times the distance L2 between the end of vane 153*b* and the end of the condenser 110 and for eliminating the whirling phenomenon, in which air is infused toward the center of the hub 153*a* when the outdoor fan 153 is rotated, and letting normal air flow formed at the center of the condenser 110 faced with the hub 153*a* to thereby enhance smooth condensation. In a typical embodiment, the distance of the extended part 153*c* relate to the hub 153*a* is as shown in FIG. 4. Here, the distance to the condenser refers to the gap to the nearest part of the interior face of the condenser. In the embodiment shown in FIG. 4, distance L3 is approximately equal to L2.

The extended part 153*c* may be integrally injection-molded with the hub 153*a* or may be attached after being manufactured as a separate injection-molded part with a diameter identical to the hub 153*a* at the region of attachment. In the example shown in FIG. 4, extended part 153*c* has the shape of a truncated cone tapering from where the extended part is attached to the hub.

In one embodiment of the invention, the distance L3 between the extended part 153*c* and the condenser 110 is L3=15 mm, where the diameter D, that is, the diameter of the circle swept by vanes 153*b* of the outdoor fan 153 is 270 mm and the distance L2 between the end of the vane 153*b* and that of the condenser 110 is 15 mm, that is, D=270 mm, L2=15 mm, L3=15 mm. This is an example of an embodiment in which L2 is larger than 0.04D but smaller than 0.07D, and L3 is larger than 0.7L2 but smaller than 1.3L2, that is, if $0.04D \leqq L2 \leqq 0.07D$, then $0.7L2 \leqq 1.3L2$.

Next, effects and operations of the present invention thus constructed will be described below. If the air conditioner is activated, supply power is applied to drive a motor 151 of the air blowing apparatus 150 and to rotate motor axes 151*a* and 151*b*, which further rotate at the same air velocity and air blowing direction as indoor fan 152 and the outdoor fan 153 fixed at the end of the motor axes to avoid racing.

When the indoor fan 152 is rotated, the room air is sequentially passed by rotating force of the indoor fan 152 through a plurality of holes (reference numerals are not designated) of a suction grill member 130, suction inlet 81 of a front panel 80 and a vaporizing unit 20, contacting with the surface of the vaporizing unit 20 and getting heat-exchanged, for instance. Then, the heat-exchanged air is sucked to the center of the indoor fan 152 at the internal space P1, and discharged toward the external periphery surface of the indoor fan 152 according to the characteristics of the vanes. Accordingly, the discharged air is guided by the partition 140 to move to the blade frame 30, and, is further guided by a discharging outlet 82 formed at one side of the front panel 80 to be discharged into the room.

At this time, the air passing at the outlet of the frame 30 is discharged into the room, horizontally changing its air flow at a swinging angle of the vertical blade 60 installed in the blade frame 30. The air passing through the discharging outlet 82 is discharged into the room, vertically changing its air flow at a swinging angle of the horizontal blade 90 installed at the discharging outlet 82.

On the other hand, when the outdoor fan 153 is rotated, outside air is infused by the rotating force of the outdoor fan 153 through a plurality of infusing holes 71 formed at both sides of the external panel 70 toward the external space P2. At the same time, the cool infused air is contacted with the surface of the compressor 100 to cool down the compression heat generated by the operating compressor 100. Then, the cool air is forcibly infused through the bell-mouth shaped through hole 121 formed at one side of the external case 120 and, at the same time, contacted by the air blowing force of the outdoor fan 153 with the surface of the condenser 110 installed at a predetermined distance from the outdoor fan 153, to be discharged outside. As a result, the condensation heat generated by the operating condenser 110 is cooled down.

In one embodiment, the distance L3 between the extended part 153*c* protruded at the hub 153*a* of the outdoor fan 153 and the condenser 110 is set identical to that L2 between the end of the vane 153*b* of the outdoor fan 153 and the condenser 110. In an example of this embodiment, the distance L3 between the extended part 153*c* and the condenser 110 is L3=15 mm, where the diameter D of the outdoor fan 153 is 270 mm and the distance L2 between the end of the vane 153*b* and that of the condenser 110 is 15 mm, that is, D=270 mm, L2=15 mm, L3=15 mm. This is an example of the more general case where, if L2 is larger than 0.04D but smaller than 0.07D, L3 is larger than 0.7L2 but smaller than 1.3L2, that is, if $0.04D \leqq L2 \leqq 0.07D$, then $0.7L2 \leqq L3 \leqq 1.3L2$. In consequence, the whirling phenomenon, in which air is infused toward the center of the extended part 153*c* in rotations of the outdoor fan 153, can be prevented and smooth, consistent condensation can be accomplished at the center of the condenser 110 faced with the extended part 153*c*.

Figure 5:
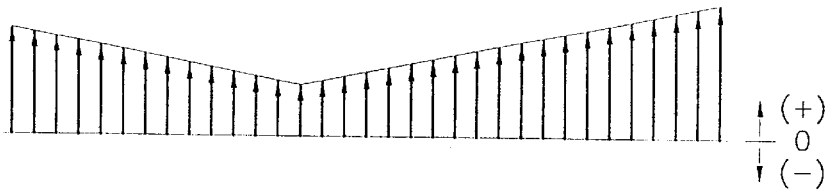
FIG. 5 is an air velocity distribution graph of air flow across the condenser of an air conditioner in accordance with an embodiment of the present invention.

As shown in the air velocity distribution graph of FIG. 5, the reduction in the distance between the extended part 153*c* of the outdoor fan 153 and the condenser 110 gets the air velocity to be its plus (+) state of the normal air flow at the distance L2 between the vane 153*b* and the end of the condenser 110 and, at the same time, at the distance L3 between the extended part 153*c* and the center of the condenser 110. In consequence, the center of the condenser 110 is contacted with the normal air flow for smooth condensation, thereby equalizing the air velocity distribution over the outdoor fan 153 and improving the general condensation efficiency of the condenser 110.

Table 1 shows a result of experiments for determining performance parameters of an air conditioner with an extended part formed at the hub of the outdoor fan in accordance with the present invention and without an extended part in accordance with the prior art.

TABLE 1

Performance parameters of air conditioners:

| Parameter | | conventional | present invention |
|---|---|---|---|
| cooling capacity | Kcal/hr | 1197.5 | 1249.6 |
| | BTU/hr | 4751.7 | 4958.4 |
| | % | 100.0 | 104.4 |
| energy consumption | W | 532.9 | 527.5 |
| energy efficiency | Kcal/hrW | 2.247 | 2.369 |
| | BTU/hrW | 8.916 | 9.400 |

The performances of the air conditioner are measured with a pocket air velocity/wind meter manufactured by NIELSON KELLERMAN CO. USA. As shown in Table 1, the cooling capacity of the present invention has increased by 52.1 Kcal/hr, 206.7 BTU/hr and 4.4% in comparison with the conventional one. Compared with the conventional air conditioner, energy consumption of the present invention has decreased by 5.4 W and energy efficiency has increased by 0.122 Kcal/hrW and 0.484 BTU/hrW. As a result, the present invention has been more effective in cooling capacity, energy consumption and energy efficiency than the conventional air conditioner.

In addition, results of air velocity distribution tests with the conventional air conditioner and the present invention have been shown in Tables 2 and 3.

TABLE 2

Result of air velocity distribution tests with a conventional air conditioner. Air velocities are shown at positions from left-to-right and top-to-bottom across the condenser.

| | | | | | | | | | | | |
|---|---|---|---|---|---|---|---|---|---|---|---|
| 4.1 | 4.0 | 2.3 | 0.8 | 0.0 | 0.0 | 0.8 | 2.1 | 3.0 | 3.8 | 4.4 | 4.4 |
| 4.8 | 3.6 | 2.1 | 0.6 | −0.2 | 0.2 | 0.8 | 1.7 | 2.5 | 3.3 | 3.6 | 3.9 |
| 4.4 | 3.4 | 2.0 | 0.8 | 0.4 | 0.0 | 0.0 | 0.8 | 1.7 | 2.4 | 2.7 | 2.9 |
| 4.3 | 3.0 | 2.0 | 1.4 | 0.6 | −0.3 | −0.5 | 0.2 | 0.9 | 1.6 | 2.0 | 2.2 |
| 3.1 | 2.9 | 2.2 | 1.8 | 0.7 | −0.5 | −0.9 | −0.9 | 0.2 | 1.1 | 1.6 | 1.8 |
| 3.2 | 2.3 | 2.2 | 1.6 | −0.3 | −0.9 | −1.1 | −0.9 | −0.2 | 0.8 | 1.3 | 1.8 |
| 3.2 | 2.9 | 2.7 | 2.5 | 0.8 | −1.2 | −1.2 | −1.1 | −0.5 | 1.0 | 1.6 | 2.0 |
| 2.8 | 3.3 | 3.1 | 3.0 | 1.1 | −0.7 | −1.0 | −0.9 | 0.5 | 1.6 | 2.1 | 2.6 |
| 3.6 | 3.5 | 3.4 | 3.4 | 2.6 | 0.4 | −0.3 | −0.6 | 0.3 | 1.8 | 2.6 | 3.5 |
| 3.9 | 3.7 | 3.9 | 3.9 | 3.4 | 1.6 | 0.7 | 0.5 | 1.5 | 2.8 | 3.6 | 4.5 |
| 3.4 | 3.9 | 4.2 | 4.0 | 3.8 | 2.8 | 1.6 | 1.6 | 2.5 | 3.3 | 3.9 | 4.0 |
| 3.1 | 4.2 | 4.4 | 4.3 | 4.3 | 3.6 | 2.6 | 2.5 | 3.3 | 3.7 | 4.2 | 4.5 |

TABLE 3

Result of air velocity distribution tests with an air conditioner of the present invention. Air velocities are shown at positions from left-to-right and top-to-bottom across the condenser.

| | | | | | | | | | | | |
|---|---|---|---|---|---|---|---|---|---|---|---|
| 4.5 | 4.6 | 3.0 | 1.8 | 0.8 | 1.4 | 2.1 | 3.3 | 3.8 | 4.8 | 4.9 | 4.4 |
| 4.0 | 3.7 | 2.4 | 1.2 | 0.9 | 1.6 | 2.5 | 2.9 | 3.3 | 3.6 | 3.8 | 3.4 |
| 4.1 | 3.6 | 2.1 | 1.0 | 1.5 | 2.0 | 1.7 | 1.6 | 2.3 | 3.1 | 3.3 | 3.1 |
| 4.6 | 3.4 | 1.7 | 1.4 | 2.7 | 2.2 | 0.8 | 0.9 | 1.6 | 2.4 | 3.0 | 3.0 |
| 4.0 | 3.5 | 2.1 | 2.5 | 3.3 | 2.0 | 0.0 | 0.0 | 0.7 | 1.6 | 2.6 | 3.1 |
| 4.0 | 3.2 | 2.4 | 3.1 | 3.7 | 1.9 | 0.0 | 0.0 | 0.7 | 1.7 | 2.6 | 3.2 |
| 3.8 | 3.2 | 2.8 | 3.9 | 3.8 | 1.5 | 0.1 | 0.0 | 0.8 | 1.8 | 2.5 | 3.5 |
| 3.6 | 3.3 | 3.0 | 4.1 | 4.2 | 2.4 | 0.5 | 0.7 | 1.3 | 2.2 | 3.3 | 4.0 |
| 3.5 | 3.7 | 3.7 | 4.3 | 4.7 | 3.5 | 1.5 | 1.1 | 2.3 | 3.4 | 4.2 | 4.5 |
| 3.2 | 3.9 | 3.7 | 4.4 | 4.6 | 3.6 | 2.5 | 2.5 | 3.4 | 3.9 | 4.7 | 4.9 |
| 3.5 | 3.9 | 4.0 | 4.5 | 4.7 | 4.1 | 3.6 | 3.5 | 4.1 | 4.7 | 5.0 | 5.0 |
| 3.7 | 4.4 | 4.5 | 4.7 | 5.2 | 5.2 | 4.8 | 4.5 | 4.7 | 4.9 | 5.1 | 5.2 |

The results of the air velocity distribution tests with the air conditioners are measured with a pocket air velocity/wind meter manufactured by NIELSON KELLERMAN CO. USA. As shown in Table 3, the average air velocity and standard air velocity variation of the present invention are respectively 3.022222 m/sec and 1.362507 m/sec with a high positive (+) air velocity distribution, that is, normal air flow, of 0 to 5.2 m/sec at the center thereof. On the other hand, the average air velocity and standard air velocity variation of the prior art are respectively 2.177564 m/sec and 1.68449 m/sec with a negative (−) air velocity distribution, corresponding to a backward air flow, of 0 to −0.9 m/sec at the center thereof. Thus, the average air velocity of the present invention, about 3.02 m/sec, is greater than that of the prior art, about 2.18 m/sec, implying a substantially greater overall air flow in the present invention. The lower variation seen in the present invention, about 1.36 m/sec compared to 1.68 m/sec in the prior art, is indicative of a more uniform flow pattern across the condenser in the present invention.

As described above, there are advantages in the air blowing apparatus of the present invention thus described in that an extended part is assembled at the hub for setting the distance between the hub and the condenser no larger than that between the vane and the condenser, thereby preventing a whirling phenomenon, in which air is infused toward the center of the hub in rotations of the outdoor fan and accomplishing smooth condensation by getting normal air flow to form at the center of the condenser faced with the hub.

What is claimed is:

1. An air conditioner, comprising:

a condenser mounted at a rear portion of the air condition to discharge heat from coolant for the air-conditioner, said condenser having an interior face;

a radial outdoor fan installed inside the air conditioner pointing toward the interior face of the condenser for infusing outside air into the air conditioner and discharging air through the condenser, said outdoor fan comprising:

an axle connected to a motor, a hub mounted on the axle, having an external surface and an axial length;

a plurality of vanes radially connected to and distributed evenly around said external surface of said hub to define a circle swept by said vanes with a diameter D, a gap between said vanes and said interior face of said condenser being a first distance;

an extended part formed on said hub, said extended part extending axially from said external surface of said hub toward said interior surface of said condenser, having an end facing said interior face and an axial length that is greater than approximately fifty percent of said axial length of said hub, a gap between said end and said interior face of said condenser being a second distance; and said second distance being less than or equal to 1.3 times said first distance.

2. The air conditioner of claim 1, said external surface being cylindrical in shape.

3. The air conditioner of claim 2, said extended part having the shape of a truncated cone tapering from where said extended part of the hub contacts said external surface of the hub toward said end of the hub.

4. The air conditioner of claim 1, said outdoor fan having a propeller shape.

5. The air conditioner of claim 4, each vane being shaped to be closer to said interior face of the condenser at a region of the vane away from said external surface of the hub than where the vane is connected to the external surface of the hub.

6. The air conditioner of claim 1, further comprising:

said first distance being in the range of 0.04 to 0.07 times the diameter of the circle swept by said vanes of the outdoor fan.

7. The air conditioner of claim 6, said second distance being greater than or equal to 0.7 times said first distance.

8. The air conditioner of claim 1, said extended part being molded separately from said hub and attached to said hub.

9. The air conditioner of claim 1, said extended part being integral with said hub.

10. The air conditioner of claim 1, said extended part being cylindrical in shape.

11. The air conditioner of claim 1, said first distance being equal to said second distance.

12. The air conditioner of claim 1, said second distance being less than said first distance.

13. The air conditioner of claim 1, with said second distance being 15 mm and said diameter of the circle swept by the vanes being 270 mm.

14. The air conditioner of claim 1, further comprising:

an external case formed in the interior of the air conditioner; and said external case having a through hole formed in the external case, said vanes of said outdoor fan being inside said through hole.

15. The air conditioner of claim 14, further comprising:

said motor being connected to said axle of the outdoor fan; and a centrifugal indoor fan connected to said motor on the opposite side of said motor from said one side.

16. The air conditioner of claim 1, further comprised of said first distance being less than or equal to 0.07D and greater than or equal to 0.04D and said second distance being less than or equal to 1.3 times said second distance and greater than or equal to 0.7 times said first distance.

* * * * *